United States Patent [19]

Kuze

[11] Patent Number: 4,898,622

[45] Date of Patent: Feb. 6, 1990

[54] ORNAMENTAL ALLOY MATERIAL AND METHOD

[75] Inventor: Takashi Kuze, Yokohama, Japan

[73] Assignee: Tokyo Shibaura Denki Kabushiki Kaisha, Kanagawa, Japan

[21] Appl. No.: 490,982

[22] Filed: May 5, 1983

Related U.S. Application Data

[63] Continuation of Ser. No. 214,336, Mar. 11, 1981, abandoned.

[30] Foreign Application Priority Data

Dec. 14, 1979 [JP] Japan ..... 54-161432

[51] Int. Cl.[4] ..... C22F 1/10

[52] U.S. Cl. ..... 148/2; 148/11.5 N; 148/427

[58] Field of Search ..... 148/2, 11.5 N, 12.7 N, 148/410, 427; 420/444

[56] References Cited

U.S. PATENT DOCUMENTS 1,992,325 2/1935 Schaarwachter ..... 148/12.7 N

FOREIGN PATENT DOCUMENTS 51-107219 9/1976 Japan .
53-1624 1/1978 Japan .
53-144818 12/1978 Japan .

*Primary Examiner*—R. Dean
*Attorney, Agent, or Firm*—Cushman, Darby & Cushman

[57] ABSTRACT

A nickel-chromium alloy with addition of silver used for ornamental purposes, such as for spectacles frames wherein silver particles of the alloy are arrayed in lines in substantially one direction. The average ratio of the longitudinal distance and width of the line is preferably more than 10.

9 Claims, 2 Drawing Sheets

ORNAMENTAL ALLOY MATERIAL AND METHOD

This is a continuation of application Ser. No. 214,336 filed Mar. 11, 1981, abandoned.

BACKGROUND OF THE PRESENT INVENTION

This invention relates to an ornamental alloy material, and more particularly to a nickel-chronium alloy including a predetermined amount of silver making it suitable for ornamental purpose, such as eye glass frames.

Stainless steel (AISI 304) and nickel silver are well known materials used for spectacle or glasses frames. However, these materials are not extremely well suited for such frames because of the color tones they exhibit. Stainless steel is darkish and exhibits a low light reflectivity. Nickel silver is reddish, because of inclusion of a large quantity of copper, and its color tone is quite different from that of platinum. Platinum is suitable for such frames and provides pleasing color tones, but it is very expensive material. Silver is also known as a material for these frames, but it is not entirely suitable because it presents strong white light due to its high light reflectivity.

Recently, nickel-chromium alloy has come to be widely used for ornamental purposes, including glass or spectacle frames because of its excellent corrosion resistance and white metallic gloss. Since the manufacturing of glasses parts requires very fine cutting and machining, fast-cutting material is needed. To realize such a fast-cutting material, nickel-chromium with the addition of silver was proposed. This conventional nickel-chromium with addition of silver was produced by adding 0.3–10 wt. % silver to nickel alloy including 5–20 wt. % chromium. This fast-cutting property is not achieved unless silver forms solid solution with either chromium or nickel. As observed through X-ray microanalyzer techniques, the results of which are shown in FIG. 1, silver is globularly distributed within the material. The white spots are silver particles and this FIGURE shows conventional nickel-chromium alloy to which silver has been added. This conventional nickel-chromium alloy that includes silver was used for the exterior portions of glasses frames, such as around the rims, for the bridge and the side pieces.

However, in preparing the conventional nickel-chromium alloy with silver no thought was given to how the silver was added or distributed through the resulting alloy. Accordingly, that alloy was not satisfactory because its color tone is not exactly what is most desirable.

SUMMARY OF THE PRESENT INVENTION

The present invention provides an improved nickel-chromium alloy to which silver has also been added in a particular manner so that the silver becomes distributed throughout the alloy in a unique fashion. With the silver distributed in this way, the alloy can be used for ornamental purposes, particularly for eye glass frames. And it presents a deep, soft white metallic gloss which has a pleasing color tone and the alloy does not exhibit any defects when subjected to fast-cutting procedures.

DETAILED DESCRIPTION OF THE PREFERRED EXEMPLARY EMBODIMENT

I have found that a platinum colored alloy can be obtained from a nickel-chromium alloy to which silver has been added and a way to accomplish the addition of silver particles so they are arrayed in lines which extend substantially in the same direction throughout the alloy.

For producing such an alloy, an ingot of about 250–500 kg, 200 mm×200 mm×600 mm−700 mm containing from about 5 to about 20 wt. % chromium and from about 0.3 to about 10 wt. % silver while the remainder nickel is prepared as will be set forth hereafter. The first step is to roll the ingot through warm rolling procedures where the ingot is repeatedly rolled using conventional rolling techniques at temperatures ranging from about 300° C. to about 400° C. to form a billet or bar. Preferably, the maximum reduction of the crosssectional area per pass during warm rolling is normally limited to about 20%. After warm rolling, the billet or bar is further processed by cold rolling into a bar having a diameter ranging from about 2 to about 4 mm. The reduction of the billet to this smaller size bar is accomplished by the cold rolling and the present reduction is preferred to be over 80%.

Figure 1:
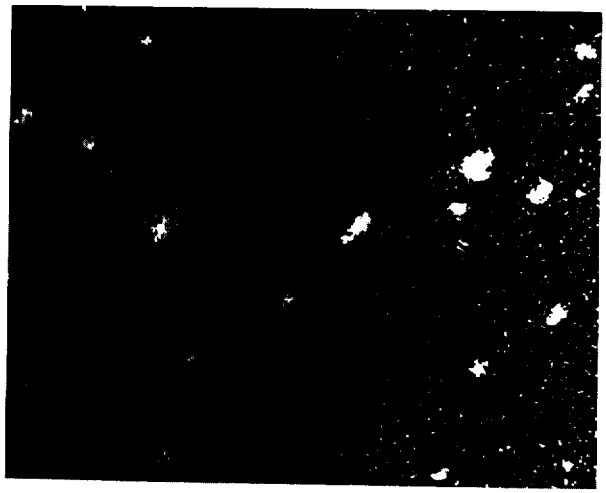
FIG. 1 shows a cross-sectional view of a conventional nickel-chromium alloy having silver added as observed through an X-ray microanalyzer (500 magnification)
Figure 2:
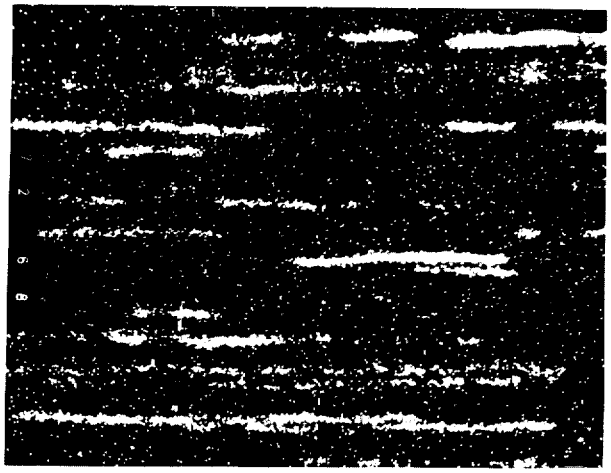
FIG. 2 shows a cross-sectional view of a nickel-chromium alloy with silver added according to the present invention through an X-ray microanalyzer (500 magnification)
Figure 3:
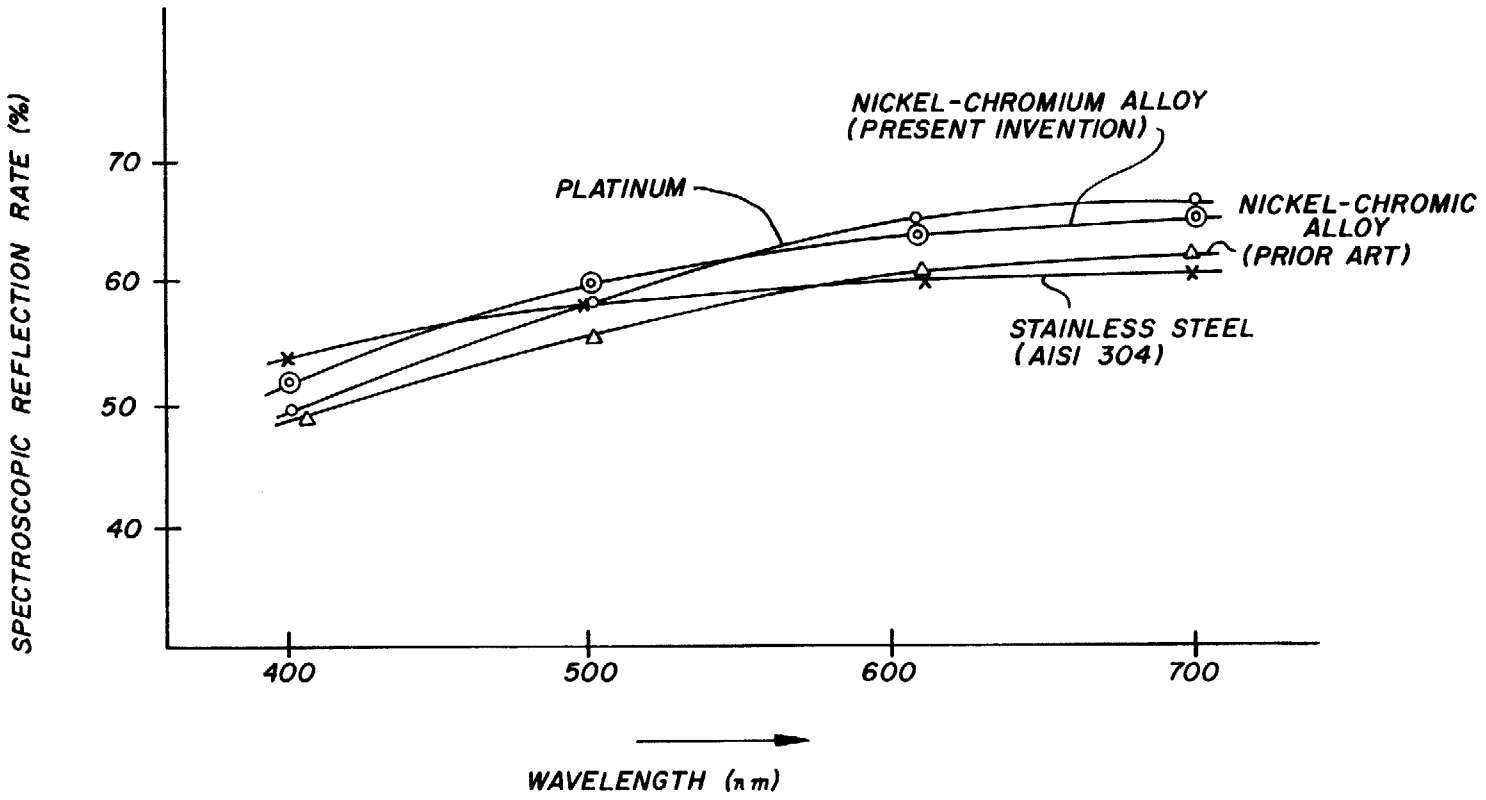
FIG. 3 shows a graph illustrating the spectroscopic reflection rate on various materials including the nickel-chromium alloy according to the present invention.

As is clear from FIG. 2, the alloy produced according to the present invention has a different cross-sectional view from that of the conventional alloy. In particular the silver particles are continuously arrayed in lines in the same direction in the alloy. It should be pointed out that the white dots uniformly seen in both FIGS. 1 and 2 are noise and do not represent the presence of silver particles. As shown in FIG. 3, the nickelchromium alloy with addition of silver according to the present invention exhibits a 52% reflection rate of light at a 400 mm wave length and a 65% reflection rate of light at a 700 mm wave length. This reflection rate of the nickel-chromium alloy with addition of silver of the present invention is higher than that of platinum at a 400 mm wave length while it is lower than platinum at a 700 mm wave length. However, the alloy of the present invention presents, in total, a color tone that is similar to platinum which is very desirable. Further, in addition to a higher reflection ratio than platinum at short wave lengths, the color tone of the present invention belongs to the so called blue family and it has no specific absorption of light in the visible range. Accordingly, a deep, soft white gloss appearance is obtained by the nickel-chromium alloy prepared with the addition of silver according to the present invention.

It is clear from the graph set forth in FIG. 3 that the nickel-chromium alloy of the present invention is superior to the conventional nickel-chromium alloy with regard to the color tone each exhibits.

I have also found that the ratio of the longitudinal distance (L) to the width (W) of the line formed by silver particles is important in order to achieve that deep, soft white gloss effect. When the average ratio L/W on each line is greater than 10, the ornamental effects are further enhanced.

The same effects may be realized even if silver particles in the nickel-chromium alloy are discontinuously arrayed in lines in the same direction. However, the ratio of L/W is still desired to be over 10, in order to assume the deep, soft white gloss effect.

The nickel-chromium alloy having silver added so as to be present in this faction produces an alloy having excellent color tone for ornamental purposes without any of the known defects and also offers corrosion resistance, mechanical strength and the ability to withstand or accept fast-cutting.

While the invention has been described in connection with what is presently considered to be the most practical and preferred embodiment to produce a new alloy with the above noted properties, it is to be understood that the invention is not to be limited to the disclosed embodiment but on the contrary, is intended to cover various modifications and equivalent arrangements included within the spirit and scope of the appended claims, which scope is to be accorded the broadest interpretation so as to encompass all such modifications and equivalent arrangements.

What is claimed is:

1. A process for preparing a nickel-chromium alloy including silver comprising the steps of preparing an ingot of the alloy mixture, consisting essentially of about 5 to about 20 weight percent chromium, about 0.3 to about 10 weight percent silver and the remainder is nickel, warm rolling the ingot at a temperature ranging from about 300 degrees to about 400 degrees Centigrade to form a billet where the cross-sectional reduction per pass is not greater than 20% and thereafter cold rolling the billet into a bar having a diameter ranging from about 2 to about 4 mm with the cross-sectional reduction being in excess of 80%.

2. An ornamental nickel-chromium alloy material formed by the process of claim 1 wherein the silver is in the form of lines of silver extending throughout the material and substantially in one direction therein.

3. A nickel-chronium alloy material as in claim 2, wherein said silver lines are formed by continuously arraying particles of silver within the material.

4. A nickel-chromium alloy material as in claim 2, wherein said silver lines are formed by discontinuously arraying particles of silver within the material.

5. A nickel-chromium alloy material as in claim 2, wherein said silver lines are both continuously and discontinuously arrayed throughout the material.

6. A nickel-chromium alloy material including silver as in claim 1,3,4 or 5, the average ratio of the longitudinal distance and the width of said line is more than 10.

7. A nickel-chromium alloy as in claim 5 to which silver has been added so that the alloy exhibits a reflection similar to a platinum alloy so that the alloy exhibits a reflection rate of light that can vary from 52% at a 400 nm wavelength and 65% at a 700 nm wavelength.

8. An alloy as in claim 7, wherein the short wave length reflection and color tone of about 400nm wave lengths lies in the blue family.

9. A platinum-colored material for decorative purposes having a spectroscopic reflection ratio of more than 63% in the wavelength range from about 600 nm to about 700 nm, formed from about 5 to about 20% chromium, about 0.3 to about 10% silver and the remainder nickel, wherein the silver is in the form of lines of silver extending throughout the material and substantially in one direction therein, the average length of said lines of silver in said direction being more than 10 times greater than the average width thereof.

* * * * *